US008905820B2

(12) United States Patent
Kountotsis et al.

(10) Patent No.: US 8,905,820 B2
(45) Date of Patent: Dec. 9, 2014

(54) SCRAPER AND SANDBLASTER ASSEMBLY AND METHODS OF USE

(71) Applicants: Theodosios Kountotsis, Melville, NY (US); Agjah Libohova, East Setauket, NY (US)

(72) Inventors: Theodosios Kountotsis, Melville, NY (US); Agjah Libohova, East Setauket, NY (US)

( * ) Notice: Subject to any disclaimer, the term of this patent is extended or adjusted under 35 U.S.C. 154(b) by 0 days.

(21) Appl. No.: 14/292,963

(22) Filed: Jun. 2, 2014

(65) Prior Publication Data

US 2014/0273759 A1 Sep. 18, 2014

Related U.S. Application Data

(63) Continuation of application No. 13/135,294, filed on Jun. 30, 2011.

(51) Int. Cl.

| | |
|---|---|
| ***B24C 1/00*** | (2006.01) |
| ***B24C 5/02*** | (2006.01) |
| ***B24C 1/04*** | (2006.01) |

(52) U.S. Cl.

CPC .... *B24C 5/02* (2013.01); *B24C 1/04* (2013.01)

USPC ..... 451/90; 451/38; 451/87; 451/102

(58) Field of Classification Search

CPC ..... B24C 5/00; B24C 5/02; B24C 5/04

USPC ..... 15/236.01, 300.1, 304, 93.1; 29/81.11; 30/169; 451/38, 67, 87, 88, 89, 90

See application file for complete search history.

(56) References Cited

U.S. PATENT DOCUMENTS

| | | | | |
|---|---|---|---|---|
| 2,483,176 | A * | 9/1949 | Bishop et al. | 451/90 |
| 3,163,963 | A * | 1/1965 | Racine Caron | 451/90 |
| 4,212,138 | A * | 7/1980 | Hutchison | 451/90 |
| 5,356,292 | A * | 10/1994 | Ho | 433/88 |

* cited by examiner

*Primary Examiner* — Lee D Wilson
*Assistant Examiner* — Tyrone V Hall, Jr.
(74) *Attorney, Agent, or Firm* — Theodosios Kountotsis

(57) ABSTRACT

A scraper and sandblaster assembly is presented including a sandblaster having at least a debris collection cover and a granular particle container for holding granular particles and a scraper configured to operate with the sandblaster, wherein the granular particle container includes a plurality of separate and distinct chambers, each chamber including a different granular particle. The sandblaster includes at least one actuation mechanism for selectively or collectively dispensing the different granular particles.

20 Claims, 12 Drawing Sheets

SECTION A-A

1100A

1100C

1100E

Same
Cross Section
1100B

1100D

1100F

1100G

Varying
Cross Section
1100H

1100I

SCRAPER AND SANDBLASTER ASSEMBLY AND METHODS OF USE

CROSS-REFERENCE TO RELATED APPLICATIONS

This application is a continuation of U.S. patent application Ser. No. 13/135,294, filed on Jun. 30, 2011, the entire disclosure of which is incorporated by reference herein.

BACKGROUND

1. Field of the Related Art

The present disclosure relates to creating a desired texture on a surface of an article or object, and more particularly, but not exclusively, to a combination sandblaster and scraper assembly for enabling concurrent or simultaneous abrasive blasting and scraping of the surface of the article or object.

2. Description of the Related Art

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions. Therefore, unless otherwise indicated herein, what is described in this section is not prior art to the description and claims in this application and is not admitted to be prior art by inclusion in this section.

Abrasive blasting, commonly referred to as sandblasting, has been widely utilized in industry as a method for cleaning and deburring objects. Applications of abrasive blasting may include methods to prepare surfaces with attractive finishes or to texturize the finish material of a surface. In other applications, surfaces of articles may require sandblasting to remove scale or debris from a product, in yet another application, sandblasting techniques may be employed in order to enhance the finish of a product surface, for example, to improve paint adhesion of the product surface. For proper adhesion of coatings, it is sometimes preferable to completely clean the exterior surface of a product and in some instances preferably roughen the surface via abrasion or by surface etching.

Abrasive material spray units generally utilize pressurized air flowing along a narrow main passageway formed in a main sprayer body and intersected by a transverse passageway extending to a supply of abrasive material, usually sand, in a supply container. The movement of air in the main passageway creates a negative pressure or similar action at the intersection of the passageways, which draws sand particles from the container into a mixing chamber thereat. The main sprayer body is usually provided with a pistol grip through which the main passageway extends. In some instances, the supply container is supported on a surface separate from the sprayer body and a flexible tube leading from the container is connected to the portion of the sprayer body forming the mixing chamber. In other instances, the supply container is connected directly to and supported by the main sprayer body so that the container with the abrasive material therein is moved about during the spraying operation.

As a result, in operation, sandblasters entrain a hard particulate material, typically fine sand, in a stream of air, which may be directed against a target site to be ablated or abrasively eroded by the particulate material. Thus, the rapidly moving particulate material hits the target site with considerable force and thereby removes surface material, for example, mold, rust, paint, and similar abradable substances.

Turning now to scrapers, the concept of scrapers and more specifically, paint scrapers is old in the art. In general, paint scrapers have a handle with a blade that is held in pressure contact with a surface from which paint is to be removed. Typically, the blade extends at about 90 degrees to the surface to be scraped and a user pulls and pushes the blade over the painted surface to remove the paint. Additionally, a conventional paint scraper generally has an upper cover, a lower cover, a blade securely sandwiched between the upper cover and the lower cover and a bolt extending from the lower cover to the upper cover to secure the engagement between the lower and the upper covers to securely hold the blade. Because the lower cover and the upper cover are engaged with each other by the bolt that is inserted through the center of the lower cover and the upper cover, only the center of the blade is pressed by the covers.

There is a need for an apparatus and method for effectively removing at least previous coatings, deposits, rust and/or scale from surfaces of articles and/or objects, and reducing fatigue of the user. The present disclosure addresses the problems of needing to apply pressure on a paint scraper for an extended period of time without fatiguing the user's arm and also addresses the problem of creating a desired textured surface in a quick and efficient manner via a versatile tool.

SUMMARY

The following presents a simplified summary of the claimed subject matter in order to provide a basic understanding of some aspects of the claimed subject matter. This summary is not an extensive overview of the claimed subject matter. It is intended to neither identify key or critical elements of the claimed subject matter nor delineate the scope of the claimed subject matter. Its sole purpose is to present some concepts of the claimed subject matter in a simplified form as a prelude to the more detailed description that is presented later.

The present disclosure provides for a scraper and sandblaster assembly. The scraper and sandblaster assembly includes a sandblaster having a gun-like configuration including a handle portion having a trigger mechanism; an air inlet portion operably coupled to the handle portion and to an air supply source; a nozzle portion distally disposed with respect to the handle portion; and a granular particle container mounted thereon for holding granular particles. The scraper is in cooperative engagement with the sandblaster, the scraper configured to operate concurrently with the sandblaster.

In another exemplary embodiment, a debris collection cover is provided encompassing at least a distal portion of the sandblaster and the scraper, the debris collection cover supported on the nozzle portion of the sandblaster. The debris collection cover may be configured to facilitate recycling of at least a portion of the granular particles dispensed from the granular particle container via the air supply source. The debris collection cover may include a compressible portion configured to deflect in opposed relation to a direction of expulsion of the granular particles dispensed from the nozzle portion of the sandblaster via the air supply source.

In another exemplary embodiment, a distal end of the scraper extends beyond the debris collection cover. A proximal end of the scraper is positioned outside a periphery of the debris collection cover.

The granular particles are at least one of sand, steel grit, steel shot, copper slag, coal slag, walnut shells, coconut shells, powdered quartz, emery, chilled iron globules, glass beads, corn cob, pumice, crushed glass grit, silicon-carbide grit, aluminum-oxide, staurolite minerals, powdered abrasives, and plastic abrasives or a combination thereof.

In yet another exemplary embodiment, the scraper is releasably detachable to the sandblaster. Alternatively, a head portion of the scraper is releasably detachable to the scraper.

In yet another exemplary embodiment, the nozzle portion may include a plurality of nozzles configured for selective or collective activation. Each of the plurality of nozzles is dimensioned and adapted to have different cross-sections to enable different dispersal rates of the granular particles.

In yet another exemplary embodiment, the granular particle container includes a plurality of separate and distinct chambers, each chamber including a different granular particle. Additionally, the handle portion includes at least one actuation mechanism for selectively or collectively enabling dispensement of the different granular particles.

The present disclosure provides for a scraper and sandblaster assembly. The scraper and sandblaster assembly includes a scraper and a sandblaster having at least one sandblasting nozzle positioned about the scraper, the sandblaster configured to cooperate with an air supply source for propelling granular particles from a granular particle container. The scraper is configured to operate concurrently with the sandblaster.

The present disclosure also provides a method of abrading a surface. The method includes the steps of providing a sandblaster having a gun-like configuration, the sandblaster including a handle portion having a trigger mechanism; an air inlet portion operably coupled to the handle portion and to an air supply source; a nozzle portion distally disposed with respect to the handle portion; and a granular particle container mounted thereon for holding granular particles; cooperatively engaging a scraper with the sandblaster; and concurrently operating the scraper with the sandblaster.

The present disclosure also provides a method for manufacturing a sandblaster and scraper assembly including forming/constructing/fabricating a sandblaster having a gun-like configuration including a handle portion having a trigger mechanism; an air inlet portion operably coupled to the handle portion and to an air supply source; a nozzle portion distally disposed with respect to the handle portion; and a granular particle container mounted thereon for holding granular particles and forming/constructing/fabricating a scraper that is in cooperative engagement with the sandblaster, the scraper configured to operate concurrently with the sandblaster.

The present disclosure also provides a method for manufacturing a sandblaster and scraper assembly including forming/constructing/fabricating a scraper and forming/constructing/fabricating a sandblaster having at least one sandblasting nozzle positioned about the scraper, the sandblaster configured to cooperate with an air supply source for propelling granular particles from a granular particle container. The scraper is configured to operate concurrently with the sandblaster.

Further scope of applicability of the present disclosure will become apparent from the detailed description given hereinafter. However, it should be understood that the detailed description and specific examples, while indicating preferred embodiments of the present disclosure, are given by way of illustration only, since various changes and modifications within the spirit and scope of the present disclosure will become apparent to those skilled in the art from this detailed description.

BRIEF DESCRIPTION OF THE DRAWINGS

Various embodiments of the present disclosure will be described herein below with reference to the figures wherein.

Figure 1:
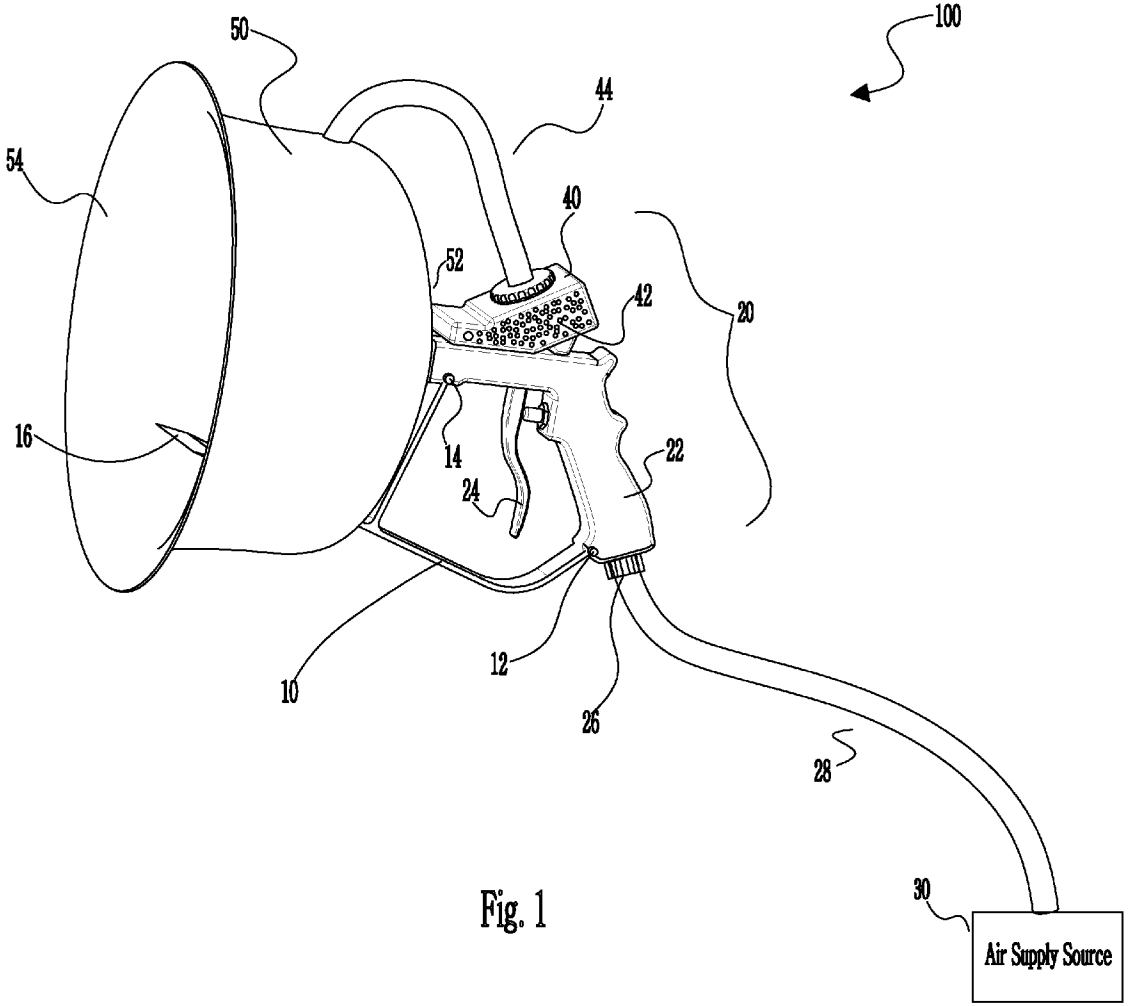
FIG. 1 is a perspective view of a sandblaster and scraper assembly in a gun-like configuration, in accordance with the present disclosure.

The figures depict preferred embodiments of the present disclosure for purposes of illustration only. One skilled in the art will readily recognize from the following discussion that alternative embodiments of the structures and methods illustrated herein may be employed without departing from the principles of the present disclosure described herein.

DETAILED DESCRIPTION

It is an object of the present disclosure to provide a system and method for combining a sandblaster with a scraper, which overcomes the shortcomings presented in the background section in a practical and efficient manner.

Accordingly, while the present disclosure is susceptible to various modifications and alternative forms, specific embodiments thereof are shown by way of example in the drawings and will herein be described in detail. It should be understood, however, that there is no intent to limit the present disclosure to the particular forms disclosed, but on the contrary, the present disclosure is intended to cover all modifications, equivalents, and alternatives falling within the spirit and scope of the present disclosure as defined by the claims. Like numbers refer to like elements throughout the description of the figures.

Unless otherwise indicated, all numbers expressing quantities and conditions, and so forth used in the specification and claims are to be understood as being modified in all instances by the term "about." The terminology used herein is for the purpose of describing particular embodiments only and is not intended to be limiting of the present disclosure. As used herein, the singular forms "a," "an," and "the" are intended to include the plural forms as well, unless the context clearly indicates otherwise. It will be further understood that the terms "comprises," "comprising," "includes," and/or "including" when used in this specification, specify the presence of stated features, integers, steps, operations, elements, and/or components, but do not preclude the presence or addition of one or more other features, integers, steps, operations, elements, components, and/or groups thereof. The term "comprise," "comprises," "comprised," or "comprising," if and when used in this document, should be interpreted non-exclusively, should be interpreted to mean "consisting of or including,"

As used herein, the term "distal" refers to that portion of the tool, or component thereof which is further from the user while the term "proximal" refers to that portion of the tool or component thereof which is closer to the user.

Prior to describing the present disclosure in further detail, it will first be helpful to define various terms that will be used throughout the following discussion. For example:

The term "connect" or "connecting" may refer at least to adhere, affix, anchor, attach, band, bind, bolt, bond, brace, button, cohere, fasten, couple, embed, establish, fix, grip, hold, hook, implant, link, lock, lodge, screw, seal, rivet, tack on, tighten, or unite. The term "connect" or "connecting" may at least refer to linking/fastening/attaching/locking any type of materials or units or components or elements in a removable/detachable/interchangeable manner. The term "connect" or "connecting" may also refer to at least materials or units or components or elements associated with each other or in operable communication with each other or cooperating with each other or in operative communication with each other.

The term "sandblast" or "sandblasting" is not limited to blasting sand only. Even though the term "sand" is associated with the term "blasting," one skilled in the art may contemplate using any type of particulate material or granular particles for abrading the surface of an article and/or object. Such particulate material or granular particles are defined herein. Thus, the term "sandblasting" or "sandblaster" is a general and broad term that relates at least to "abrasive blasting," The term "sandblasting" or "sandblaster" is a general and broad term for describing at least an apparatus or device or machine or instrument or tool for propelling or shooting or ejecting one or more substances or abrasive materials or particulate matter onto at least a surface of an article and/or object. The terms and exemplary embodiments of the present disclosure are not limited to "sand" only.

The word "exemplary" is used herein to mean "serving as an example, instance, or illustration." Any embodiment described herein as "exemplary" is not necessarily to be construed as preferred or advantageous over other embodiments. The word "example" may be used interchangeably with the term "exemplary."

The present disclosure refers to a system and method that enables the use of a sandblaster in combination with a scraper. In other words, a scraper may be used concurrently or simultaneously or synchronously with a sandblaster. The operation of the sandblaster is compatible with the operation of the scraper. Such scraper and sandblaster assembly allows for more versatility, while increasing applied coverage areas in scraping or sandblasting operations. The system for blasting abrasive material on an article or object includes a means for supplying air (i.e., an air supply source), a means for receiving air rigidly attached to the air supply means, a means for supplying the abrasive material to the air receiving means, and a means for directing the abrasive material towards the article or object. The system also includes a means to confine the particle residue and/or abrasive particles against escaping outwardly of a cover. The system also includes a means to withdraw abrasive particle residue and/or abrasive particles after directing such particles onto an article or object.

The present disclosure also refers to a dual action tool assembly including a scraper and a sandblaster for providing increased versatility. The dual action tool is configured to enable dual functionality (i.e., scraping and sandblasting) with the ease and convenience of using a single tool assembly. The scraper may include a blade and a blade holder, whereas the sandblaster may include a nozzle connected to a handle portion and a granular particle container actuated by an air supply source. The dual action tool may also include a debris collection cover to shield the user from particulate material residue or stray particulate matter. The debris collection cover may also include a feedback mechanism for recycling or recovering or salvaging or reclaiming or reusing particulate matter already dispensed from the nozzle of the sandblaster portion of the dual action tool.

The present disclosure refers to a system and method that enables dual functionality of a tool or instrument. The dual functionality refers to scraping and abrasive blasting. Thus, the scraper operates in conjunction with or in tandem with the sandblaster. These functions may be simultaneously enabled during operation of the tool or instrument. Of course, such dual functions may be selectively or switchably enabled in real-time.

Reference will now be made in detail to embodiments of the present disclosure. While certain embodiments of the present disclosure will be described, it will be understood that it is not intended to limit the embodiments of the present disclosure to those described embodiments. To the contrary, reference to embodiments of the present disclosure is intended to cover alternatives, modifications, and equivalents as may be included within the spirit and scope of the embodiments of the present disclosure as defined by the appended claims.

Embodiments will be described below while referencing the accompanying figures. The accompanying figures are merely examples and are not intended to limit the scope of the present disclosure.

With reference to FIG. 1, there is presented a perspective view of a sandblaster and scraper assembly in a gum-like configuration, in accordance with the present disclosure.

The sandblaster and scraper assembly 100 includes a scraper 10 configured to be connected to a sandblaster 20. The sandblaster 20 includes a handle portion 22 having a trigger mechanism 24. The sandblaster 20 also includes an air inlet portion 26 operably coupled to the handle portion 22 and to an air supply source 30 via an air intake tube 28. A granular particle container 40 is configured to be mounted on the sandblaster 20 for holding granular particles 42. The sandblaster 20 also includes a nozzle portion 210 (see FIG. 2A) distally disposed with respect to the handle portion 22.

Figure 2B:
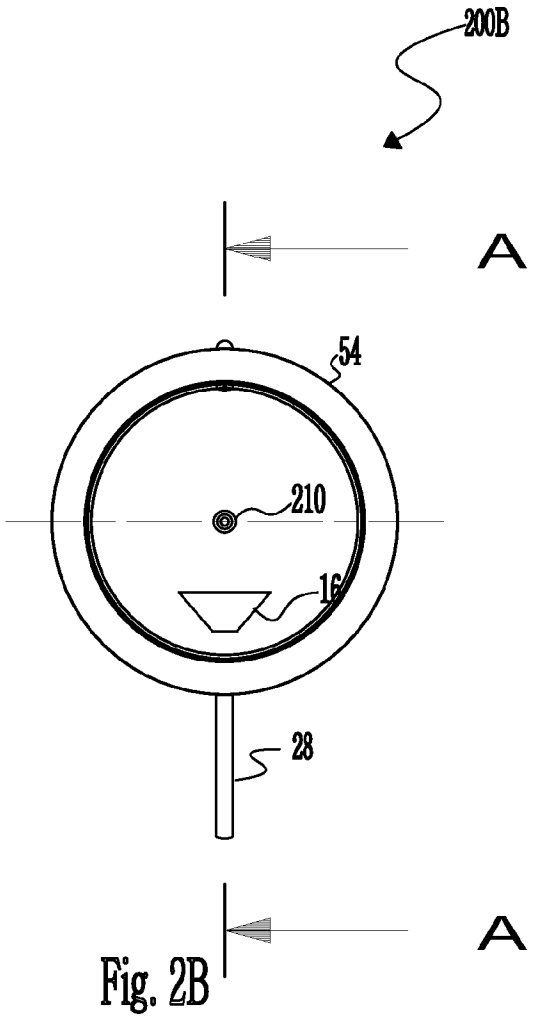
FIG. 2B is a front view of the sandblaster and scraper assembly of FIG. 1, in accordance with the present disclosure.
Figure 2A:
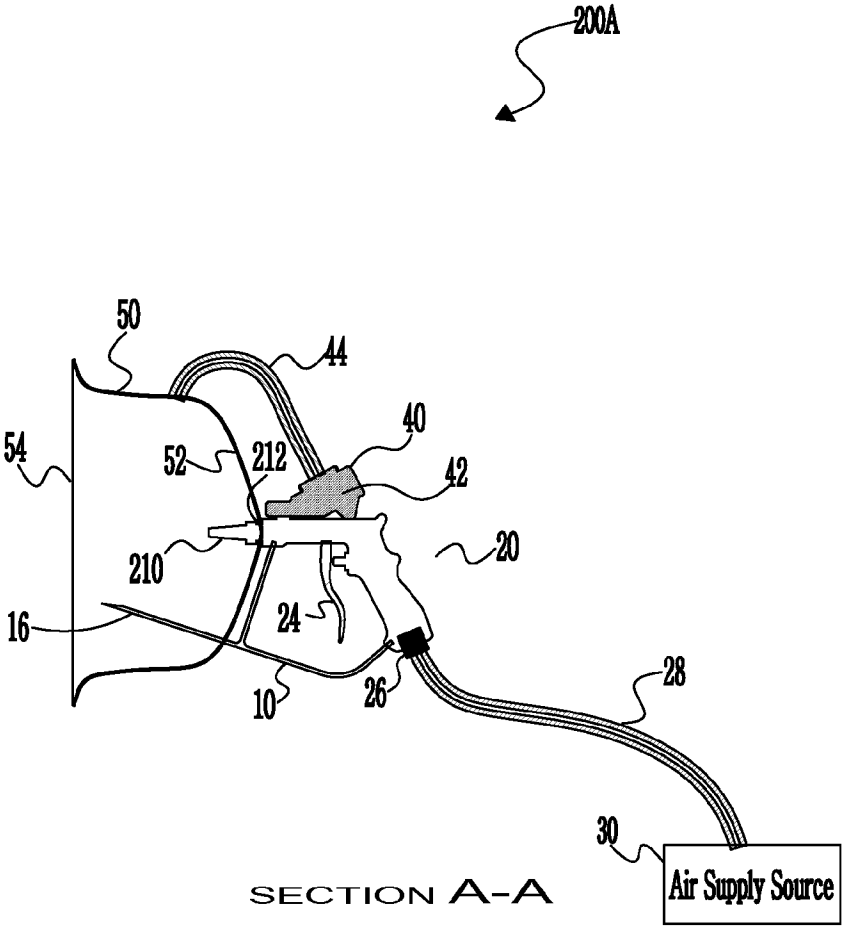
FIG. 2A is a cross-sectional view of the sandblaster and scraper assembly of FIG. 1, in accordance with the present disclosure.

The scraper 10 is configured to be connected to the sandblaster 20 via, for example, a first connecting mechanism 12 positioned at a bottom part of the handle portion 22 and a second connecting mechanism 14 positioned in proximity to the nozzle portion 210 (see FIG. 2A). One skilled in the art may contemplate using a plurality of different connecting mechanisms for connecting the scraper 10 to the sandblaster 20. The scraper also includes a blade 16 at a distal end thereof. The blade 16 is dimensioned and adapted to be used for scraping an article or object (e.g., paint or rust off of a surface).

The scraper 10 is configured to be in cooperative engagement or associated with or in mechanical connection with the sandblaster 20, such that the scraper 10 and the sandblaster 20 operate concurrently or simultaneously or synchronously with each other. Therefore, the scraper 10 is integrated or conjoined or combined or incorporated with the sandblaster 20 to create a unified assembly for providing a dual action tool mechanism. In operation, the dual action tool assembly enables at least scraping and sandblasting functions to take place to provide functional versatility. The user may also switch between the scraping and sandblasting functions, as described further below.

The sandblaster and scraper assembly 100 further includes a debris collection cover 50 having a proximal end 52 and a distal end 54. The debris collection cover 50 is configured to encompass at least a portion of the sandblaster 20 and the scraper 10. The debris collection cover 50 is supported on the nozzle portion 210 (see FIG. 2A) of the sandblaster 20. Additionally, the debris collection cover 50 is configured to facilitate recycling or recapturing or reuse of at least a portion of the granular particles 42 dispensed from the granular particle container 40 via the air supply source 30. The debris collection cover 50 may be operably associated with the granular particle container 40 via a debris collection tube 44. The debris collection tube 44 may be connected to any portion of the debris collection cover 50. Additionally, one skilled in the art may contemplate using a plurality of debris collection tubes ion different shapes and sizes and configurations.

The granular particles 42 are at least one of sand, steel grit, steel shot, copper slag, coal slag, walnut shells, coconut shells, powdered quartz, emery, chilled iron globules, glass heads, corn cob, pumice, crushed glass grit, silicon-carbide grit, aluminum-oxide, staurolite minerals, powdered abrasives, and plastic abrasives or a combination thereof. One skilled in the art may contemplate using a plurality of other granular particles or any combination thereof based on the desired application, as further described below.

The debris collection cover 50 has been added because conventional spray devices do not take into account the hazardous conditions that may develop when the user brings the spray nozzle very close to the surface being sprayed when it is directed at right angles thereto. In such case, the abrasive material may reflect at high velocities off of the surface and strike and injure the operator and damage the spray unit. Also, in some cases the spray nozzle may become clogged with the abrasive material so that the air pressure is directed into the supply container where it could force the adhesive material through the vent and thereby injure the operator if the vent is directed toward the user, or drop by force of gravity the abrasive material upon the user if the vent is directed upwards. As such, the debris collection cover 50 of the present disclosure prevents such instances from occurring by protecting the user from stray granular particles. Additionally, the debris collection cover 50 of the present disclosure has an additional purpose, that is, the capability to recycle or recapture or reuse at least a portion of the residue particles or actual particles that bounce or reflect off a surface of an article and/or object to be abraded to, for example, prevent waste.

Moreover, one skilled in the art may contemplate switching between the scraping and sandblasting operations. In other words, the user may wish to use the scraper 10 to, for example, scrape off a heavily rusty surface, and then may prefer to turn off the operation of the scraper 10 and activate the sandblaster 20 to propel finely tuned particles to smooth the surface after the rust has been removed. Therefore, even though the scraper 10 and the sandblaster 20 may be used concurrently, they may also be selectively or switchably used. Thus, a user may switch between the two operations, at will, during a single task, as he/she sees fit based on the surface worked upon. Any type of actuation mechanism may be provided to enable the selectable or switchable mechanism to take effect.

With reference to FIG. 2A, there is presented a cross-sectional view of the sandblaster and scraper assembly of FIG. 1, in accordance with the present disclosure. With reference to FIG. 2B, there is presented a front view of the sandblaster and scraper assembly of FIG. 1, in accordance with the present disclosure.

The cross sectional view 200A clearly illustrates the nozzle 210 of the sandblaster 20. The nozzle portion 210 includes a cover support mechanism 212 for supporting the debris collection cover 50 thereon. Of course, the debris collection cover 50 may be supported on any portion of the sandblaster 20. Additionally, as clearly shown in FIG. 2A, the distal end of the scraper 10 having the blade member 16 does not extend beyond the distal end 54 of the debris collection cover 50. Additionally, a proximal end of the scraper 10 is positioned outside a periphery of the debris collection cover 50. Of course, a considerably larger portion of the scraper 10 may be positioned within the debris collection cover 50. One skilled in the art may contemplate designing a plurality of different configurations to combine the scraper 10 with the sandblaster 20 in order to achieve optimum scraping or sandblasting of a surface of an article or object. FIG. 2B merely illustrates a front view 200B of the scraper and sandblaster assembly 100 of FIG. 1.

Figure 3A:
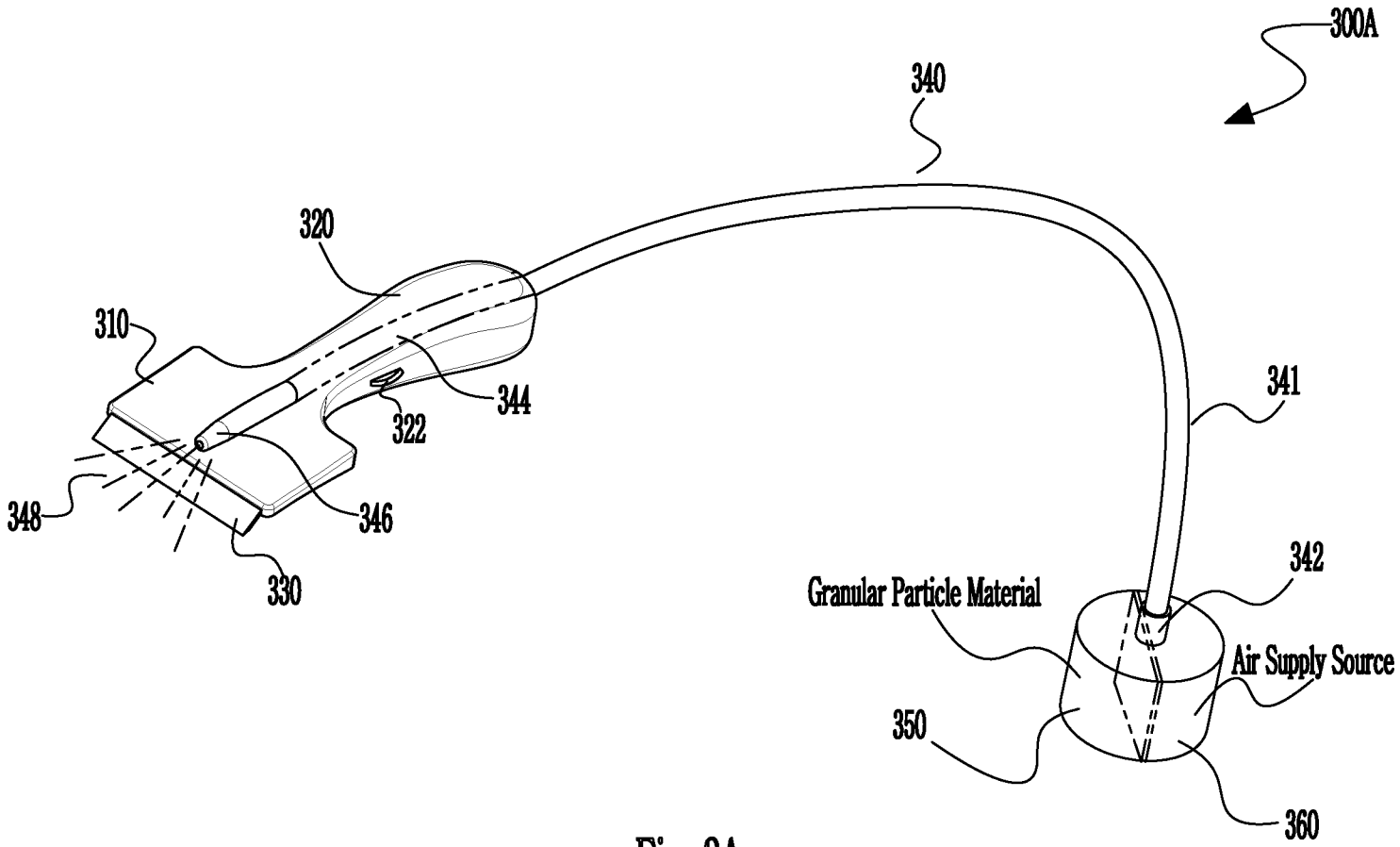
FIG. 3A is a perspective view of a sandblaster and scraper assembly, including a single scraping blade with one dispensing sandblasting nozzle, in accordance with another embodiment of the present disclosure.

With reference to FIG. 3A, there is presented a perspective view of a sandblaster and scraper assembly, including a single scraping blade with one sandblasting dispensing nozzle, in accordance with another embodiment of the present disclosure.

The scraper and sandblaster assembly 300A includes a head portion 310 operably connected to a handle 320. The head portion 310 includes a blade 330. A sandblaster portion 340 may be connected to the scraper configuration 310/320 via a tube 341 connected to a granular material container 350 and an air supply source 360. The air supply source 360 cooperates with the granular material container 350 to propel granular materials 348 through the tube 341 toward the nozzle 346. The tube 341 is connected to the granular material container 350 and the air supply source 360 via an inlet connection 342. The granular materials 348 are dispensed from the nozzle 346. The tube 341 may extend through the handle 320 and exit from an opening of the head portion 310 to expose the nozzle 346. An actuating unit 322 may be positioned on the handle 320 in order to activate the propulsion of granular materials 348 from the granular material container 350, through the tube 341 via the air supply source 360, through an inner tube portion 344 of handle 320, toward the nozzle 346. In the scraper and sandblaster assembly 300A there is presented a single blade member 330. However, one skilled in the art may contemplate using a plurality of different blades in a plurality of different shapes and sizes.

Figure 3B:
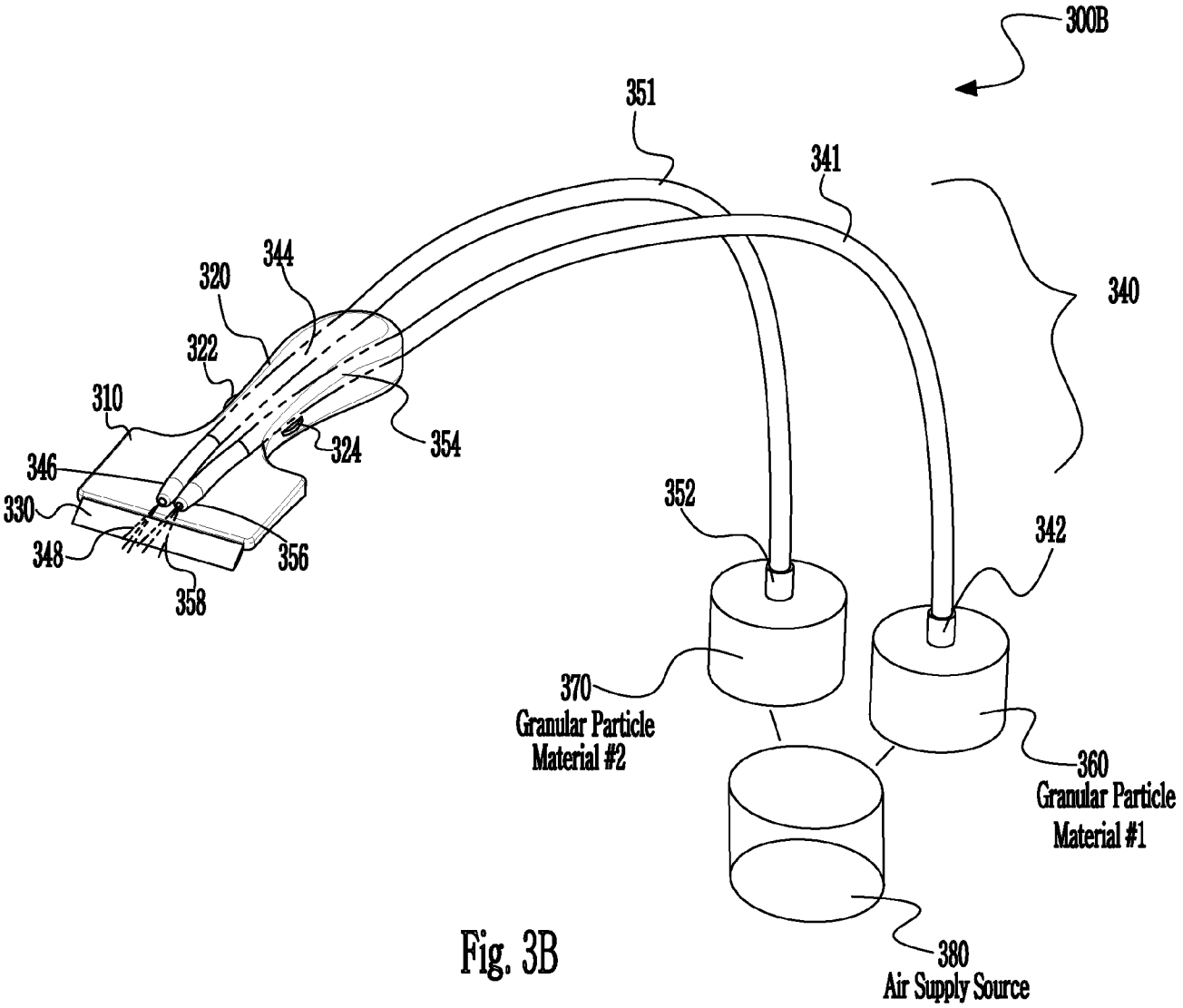
FIG. 3B is a perspective view of a sandblaster and scraper assembly, including a single scraping blade with two dispensing sandblasting nozzles, in accordance with the present disclosure.

With reference to FIG. 3B, there is presented a perspective view of a sandblaster and scraper assembly, including a single scraper blade with two sandblasting dispensing nozzles, in accordance with the present disclosure.

The scraper and sandblaster assembly 300B is similar to FIG. 3A. As such, for sake of clarity, similar reference numerals to FIG. 3A will not be discussed. A sandblaster portion 340 may be connected to the scraper configuration 310/320 via a first tube 341 connected to a first granular material container 360 and a second tube 351 connected to a second granular material container 370. An air supply source 380 cooperates with the first and second granular material containers 360, 370 to propel granular materials 348, 358 through the first tube 341 and the second tube 351, respectively, toward the first nozzle 346 and the second nozzle 356, respectively. The first and second tubes 341, 351 are connected to the first granular material container 360 and the second granular material container 370, respectively, via a first inlet connection 342 and a second inlet connection 352, respectively.

The first granular materials 348 are dispensed from the first nozzle 346 and the second granular materials 358 are dispensed from the second nozzle 356. The first tube 341 and the second tube 351 may extend through the handle 320 and exit from two openings of the head portion 310 to expose the first and second nozzles 346, 356. A first actuating unit 322 and a second actuating unit 324 may be positioned on the handle 320 in order to activate the propulsion of first and second granular materials 348, 358, respectively, from the first and second granular material containers 360, 370, respectively, through the first and second tubes 341, 351, respectively, via the air supply source 380, through first and second inner tube portions 344, 354, respectively, of handle 320, toward the first and second nozzles 346, 356, respectively. In the scraper and sandblaster assembly 300B there is presented a single blade member 330. However, one skilled in the art may contemplate using a plurality of different blades in a plurality of different sizes.

Figure 4A:
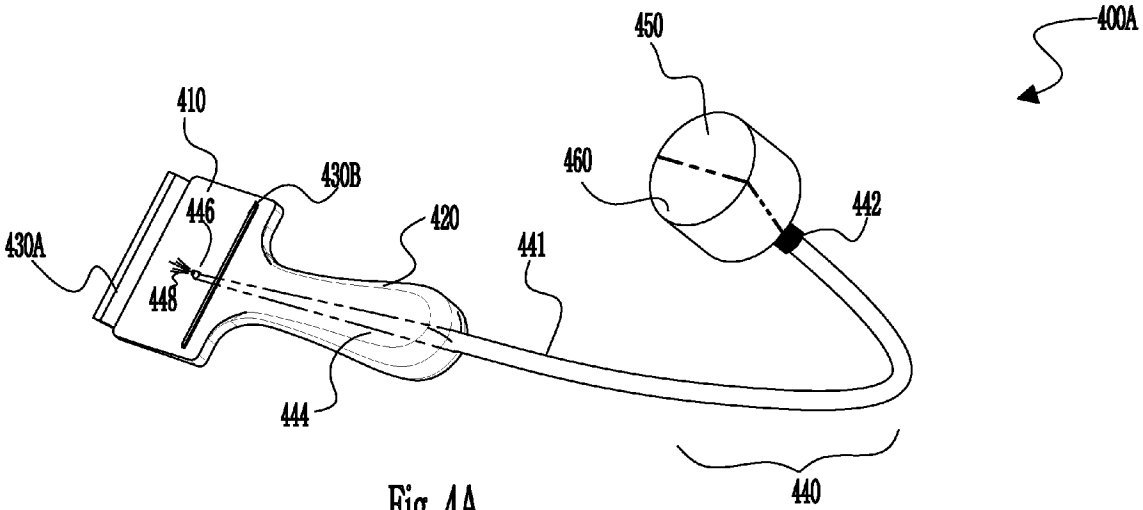
FIGS. 4A-4C are perspective views of a sandblaster and scraper assembly, including dual scraping blades with multiple types of sandblasting dispensing nozzles, in accordance with the present disclosure.
Figure 4B:
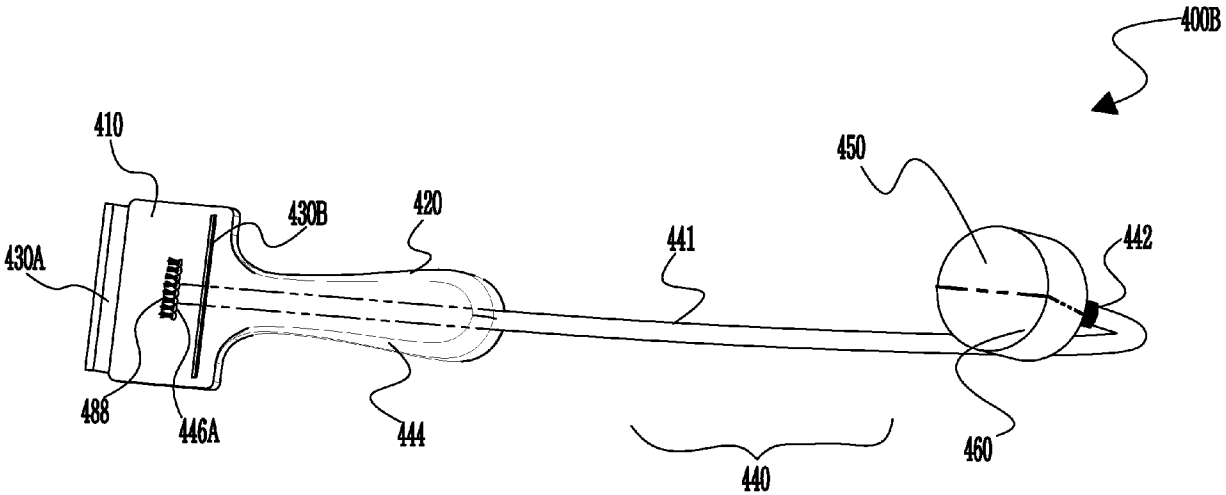
Figures 4C, 5:
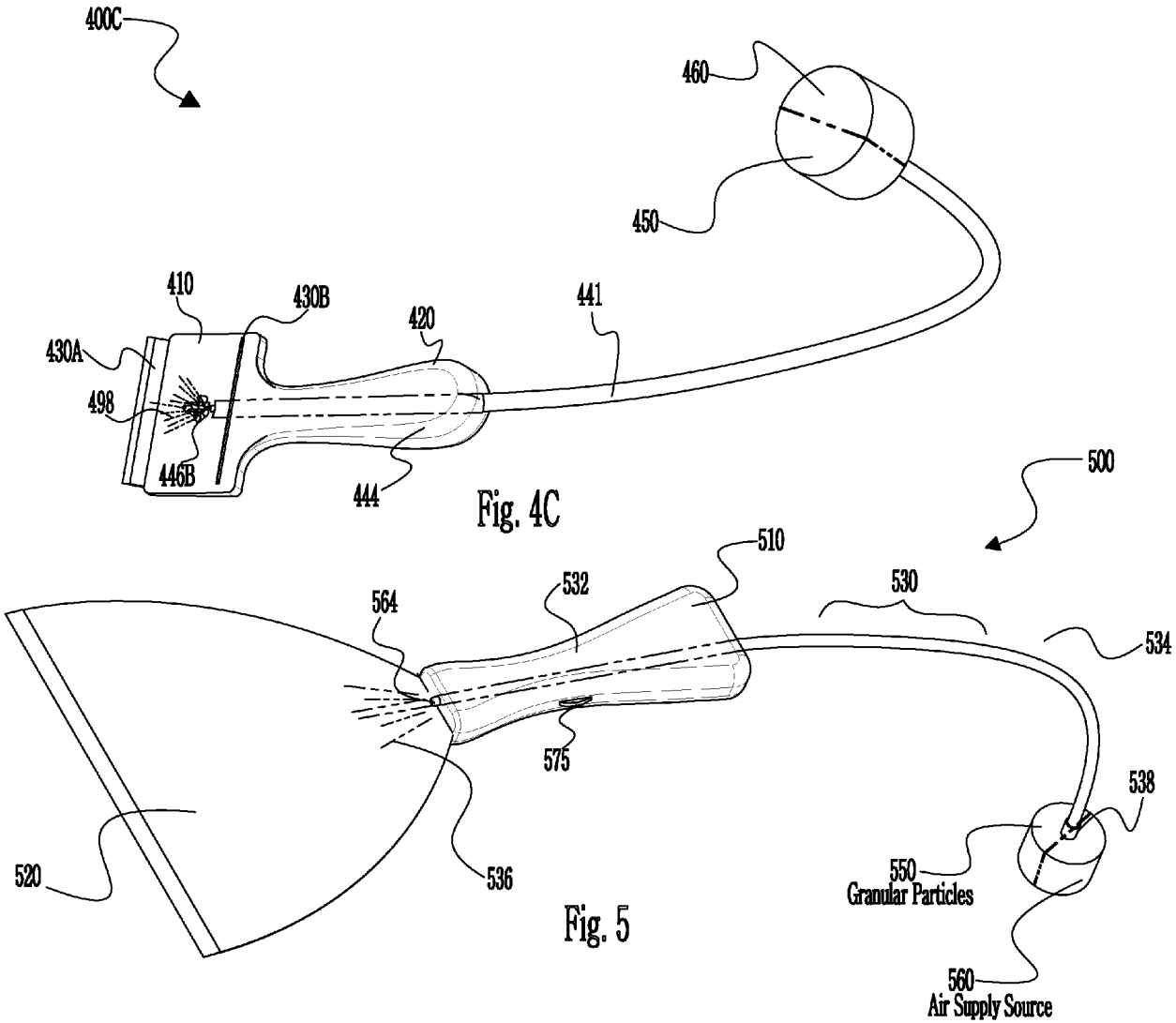
FIG. 5 is a perspective view of a sandblaster and scraper assembly, in accordance with another embodiment of the present disclosure.

With reference to FIGS. 4A-4C, there is presented perspective views of a sandblaster and scraper assembly, including a dual scraping blade with multiple types of dispensing nozzles, in accordance with the present disclosure.

The scraper and sandblaster assembly 400A includes a head portion 410 operably connected to a handle 420. The head portion 410 includes a first blade 430A and a second blade 430B. A sandblaster portion 440 may be connected to the scraper configuration 410/420 via a tube 441 connected to a granular material container 450 and an air supply source 460. The air supply source 460 cooperates with the granular material container 450 to propel granular materials 448 through the tube 441 toward the nozzle 446. The tube 441 is connected to the granular material container 450 and the air supply source 460 via an inlet connection 442. The granular materials 448 are dispensed from the nozzle 446. The tube 441 may extend through the handle 420 and exit from an opening of the head portion 410 to expose the nozzle 446. An actuating unit (not shown) may be positioned on the handle 420 in order to activate the propulsion of granular materials 448 from the granular material container 450, through the tube 441 via the air supply source 460, through an inner tube portion 444 of handle 420, toward the nozzle 446. In the scraper and sandblaster assembly 400A there are presented two blades 430A, 430B, in opposed correspondence to the nozzle 446. The two blades 430A, 430B may be considered a double-edge scraper.

FIG. 4B illustrates a plurality of nozzles 446A in a series configuration 488, whereas FIG. 4C illustrates a plurality of nozzles 446B in a diamond configuration 498. One skilled in the art may contemplate creating and using a plurality of different nozzle design configurations, as will be discussed in further detail with reference to FIGS. 11A-11I.

With reference to FIG. 5, there is presented a perspective view of a sandblaster and scraper assembly, in accordance with another embodiment of the present disclosure.

The scraper and sandblaster assembly 500 may be a flat scraper configuration including a handle 510 and a scraper blade 520. A sandblaster portion 530 may be connected to the scraper configuration 510/520 via a tube 534 connected to a granular material container 550 and an air supply source 560. The air supply source 560 cooperates with the granular material container 550 to propel granular materials 536 through the tube 534 toward the nozzle 564. The tube 534 is connected to the granular material container 550 and the air supply source 560 via an inlet connection 538. The granular materials 536 are dispensed from the nozzle 564. The tube 534 may extend through the handle 510 and exit from an opening to expose the nozzle 564. An actuating unit 575 may be positioned on the handle 510 in order to activate the propulsion of granular materials 536 from the granular material container 550, through the tube 534 via the air supply source 560, through an inner tube portion 532 of handle 510, toward the nozzle 564.

Figure 6:
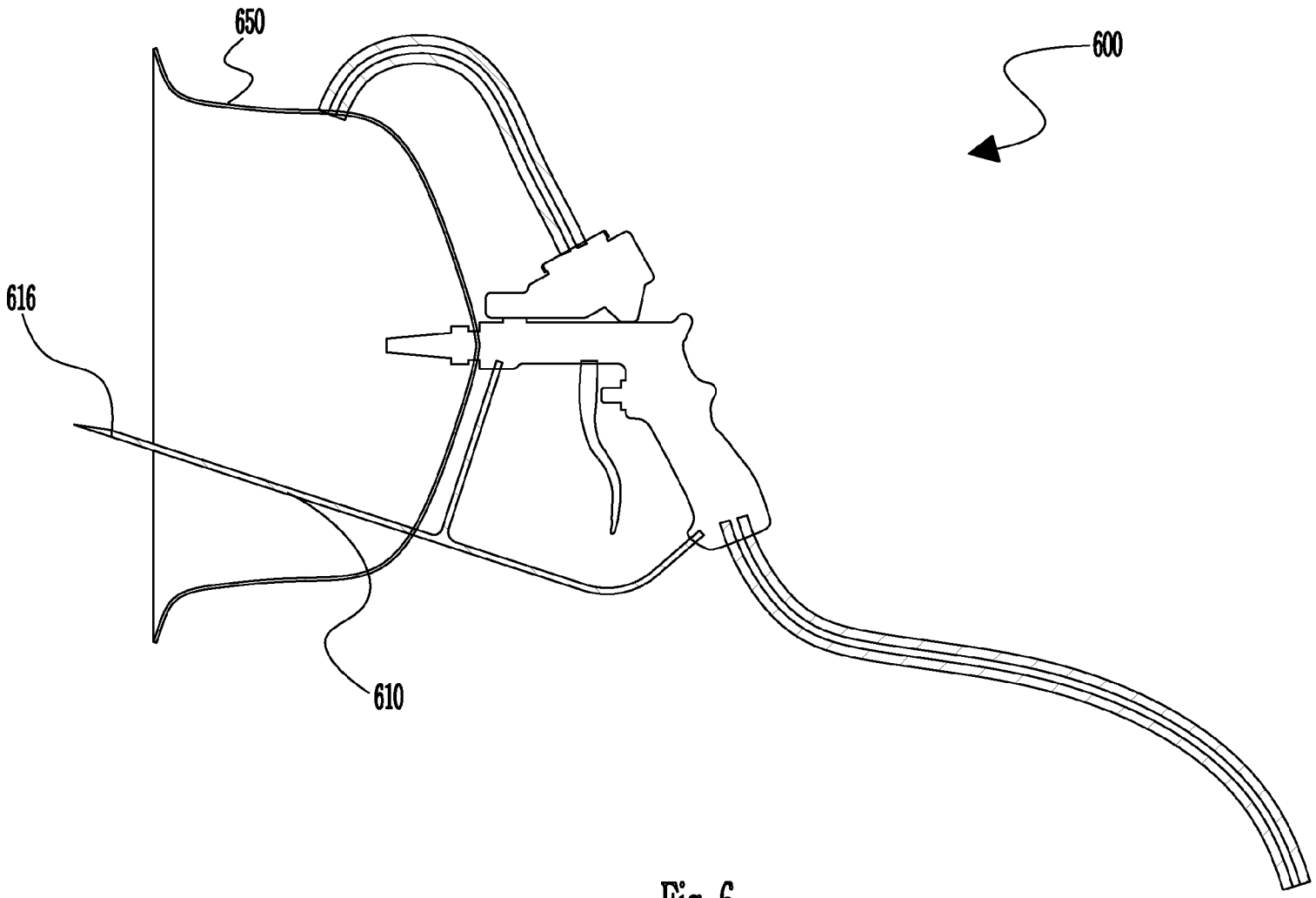
FIG. 6 is a perspective view of a sandblaster and scraper assembly, where a portion of the scraper extends beyond the cover to expose the scraping blade, in accordance with the present disclosure.

With reference to FIG. 6, there is presented a perspective view of a sandblaster and scraper assembly, where a portion of the scraper extends beyond the cover to expose the blade, in accordance with the present disclosure.

The scraper and sandblaster assembly 600 includes a scraper 610, where the distal end 616 of the scraper 610 extends beyond the debris collection cover 650. One skilled in the art may contemplate provided a number of different length scrapers to be combined with the sandblaster to form a scraper and sandblaster assembly. One skilled in the art may contemplate positioning the scraper 610 in a plurality of different angle configurations with respect to the scraper and sandblaster assembly 600. For example, the scraper 610 may be positioned 45 degrees or 30 degrees with respect to the scraper and sandblaster assembly 600.

Figure 7B:
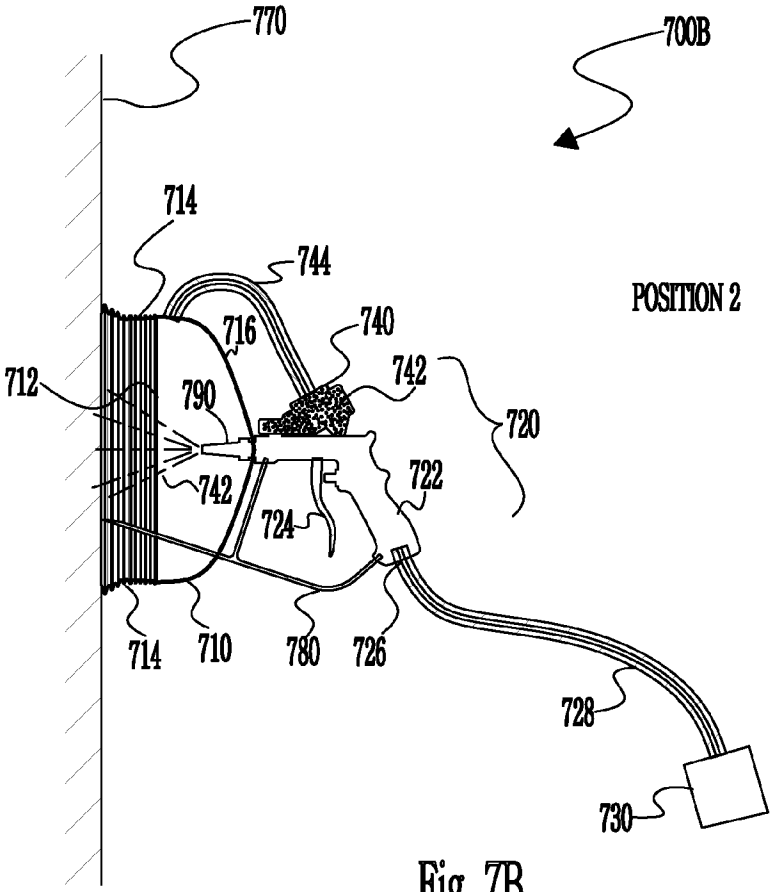
FIGS. 7A-7B are perspective views of the sandblaster and scraper assembly of FIG. 1 having a compressible cover, in accordance with the present disclosure.
Figure 7A:
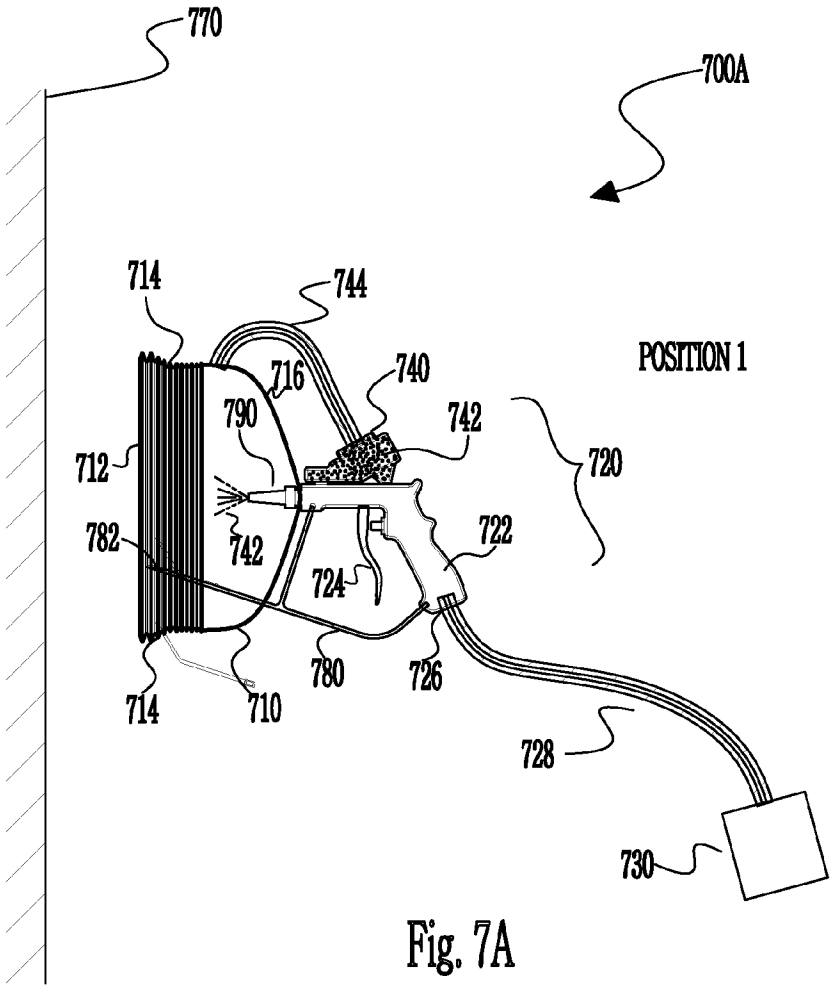

With reference to FIGS. 7A-7B, there is presented perspective views of the sandblaster and scraper assembly of FIG. 1 having a compressible cover, in accordance with another embodiment of the present disclosure.

FIG. 7A illustrates a scraper and sandblaster assembly 700A, in a first position, that includes a scraper 780 configured to be connected to a sandblaster 720. The sandblaster 720 includes a handle portion 722 having a trigger mechanism 724. The sandblaster 720 also includes an air inlet portion 726 operably coupled to the handle portion 722 and to an air supply source 730 via an air intake tube 728. A granular particle container 740 is mounted on the sandblaster 720 for holding granular particles 742. The sandblaster also includes a nozzle portion 790 distally disposed with respect to the handle portion 722.

The scraper includes a blade 782 at a distal end thereof. The scraper 780 is configured to be in cooperative engagement or associated with or in mechanical connection with the sandblaster 720, such that the scraper 780 and the sandblaster 720 operate concurrently or simultaneously with each other. Therefore, the scraper 780 is integrated or conjoined or combined or incorporated with the sandblaster 720 to create a unified assembly for providing a dual action tool assembly. In operation, the dual action tool assembly enables at least scraping and sandblasting functions to take place to provide functional versatility.

The sandblaster and scraper assembly 700A further includes a debris collection cover 710 having a proximal end 716 and a distal end 712. The debris collection cover 710 is configured to encompass at least a portion of the sandblaster 720 and the scraper 780. The nozzle portion 790 is positioned within the debris collection cover 710. The nozzle portion 790 is configured to dispense granular particles 742. The debris collection cover 710 may be operably associated with the granular particle container 740 via a debris collection tube 744. The debris collection tube 744 may be connected to any portion of the debris collection cover 710.

In the exemplary embodiment of FIG. 7A, the cover includes compressible portion 714. The compressible portion 714 may circumferentially engage the outer perimeter or surface of the debris collection cover 710. FIG. 7B, illustrates the scraper and sandblaster assembly 700B, in a second position, where the distal end 712 of the debris collection cover 710 contacts, for example, a wall 770 (or any other article or object). Upon contact with the wall 770, the compressible portion 714 compresses against the wall 770 such that the distal end 782 of the scraper 780 also contacts the wall 770 in order to allow dual action functionality of the sandblaster and scraper assembly 700B (i.e., scraping via the scraper 780 and sandblasting via the sandblaster 720).

Of course, one skilled in the art may contemplate using a clear or transparent cover to shield the user from stray granular particles or from granular particle residue, as a result of contact with the wall 770. Thus, the debris collection cover 710 includes a compressible portion 714 configured to deflect in opposed relation to a direction of expulsion of the granular particles 742 dispensed from the nozzle portion 790 of the sandblaster 720 via the air supply source 730.

It is contemplated that the entire debris collection cover 710 is compressible. It is contemplated that select portions of the debris collection cover 710 are compressible. It is contemplated that alternating portions of the debris collection cover 710 are compressible. The compressible portion 714 may compress like, for example, an accordion. The compressible portion 714 may be a flexible member or a squeezable material or a stretchable material that may be reduced or enlarged based on the pressure applied to the distal end of the collection cover 710.

Figure 8:
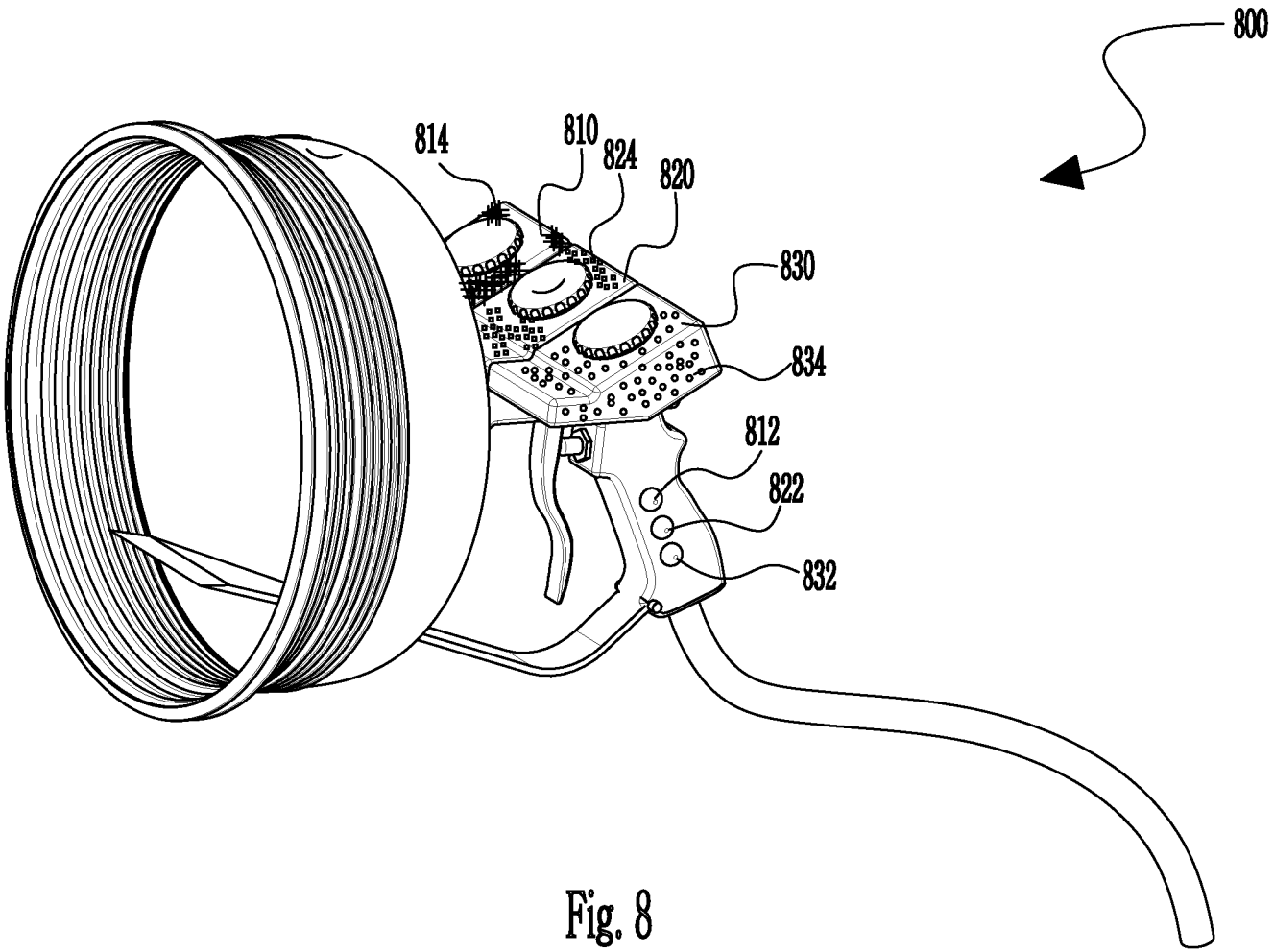
FIG. 8 is a perspective view of the sandblaster and scraper assembly of FIG. 1 having multiple granular particle containers mounted thereon and actuated by one or more trigger mechanisms, in accordance with the present disclosure.

With reference to FIG. 8, there is presented a perspective view of the sandblaster and scraper assembly of FIG. 1 having multiple granular particle containers actuated by one or more trigger mechanisms, in accordance with the present disclosure.

The scraper and sandblaster assembly 800 is similar to FIG. 1. As such, for sake of clarity, similar reference numerals to FIG. 1 will not be discussed. In contrast to FIG. 1, the scraper and sandblaster assembly 800 includes a plurality of granular particle containers positioned, for example, adjacent each other and mounted on a portion of the sandblaster. For example, three containers 810, 820, 830 are shown in FIG. 8. Of course, one skilled in the art may contemplate using a different number of containers. Each container 810, 820, 830 may be configured to hold a different granular material. For example, the first container 810 may include sand 814, the second container 820 may include steel grit 824 and the third container 830 may include silicon-carbide grit 834.

The dispensing of each granular material 814, 824, 834 may be achieved by a plurality of actuation mechanisms positioned on the scraper and sandblaster assembly 800. For example, the dispensement of the first granular material 814 may be enabled via actuation unit 812, the dispensement of the second granular material 824 may be enabled via actuation unit 822, and the dispensement of the third granular material 834 may be enabled via actuation unit 832. Of course, one skilled in the art may contemplate using a plurality of different actuation mechanisms (e.g., triggers, buttons, switches, etc.) to activate one or more of the granular materials 814, 824, 834. It is also contemplated that the granular material 814, 824, 834 may be selectively dispensed or collectively dispensed.

Therefore, in accordance with FIG. 8, a plurality of separate and distinct chambers may be provided, each chamber including a different granular particle. At least one actuation mechanism may be used for selectively or collectively enabling dispensement of the different granular particles. Moreover, the granular particles may be selectively or collectively dispensed based on the desired application. For example, a user of the scraper and sandblaster assembly 800 may determine that a certain surface would best be smoothed by dispensing two granular particles (e.g., sand and pumice) simultaneously. Each granular particle may be dispensed at the same rate or at different rates from nozzles having the same or different cross-sections. Such exemplary nozzle configurations are further described with reference to FIGS. 11A-11I.

One skilled in the art may contemplate using a plurality of different indication and/or notification mechanisms for indicating when the dispensement of granular particles has taken place or is taking place. The plurality of indication mechanisms may be visual mechanisms or audible mechanisms or a combination thereof. Also, the first, second, and third indication/actuation mechanisms 812, 822, 832 may be of any size imaginable, from a few millimeters to a few inches and constructed from any type of materials (LEDs, LCDs, or flexible displays).

Figure 9B:
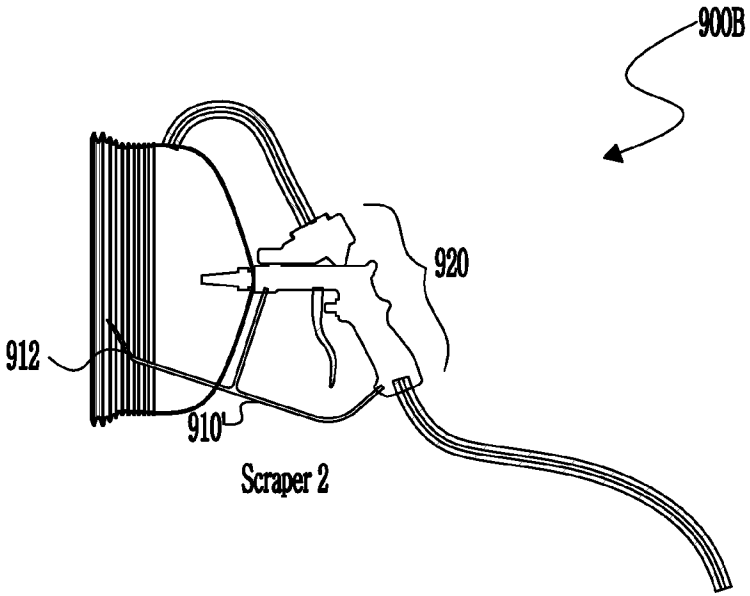
FIGS. 9A-9B are perspective views of a scraper and sandblaster assembly where the scraper is releasably detachable from the sandblaster portion of the assembly, in accordance with the present disclosure.
Figure 9A:
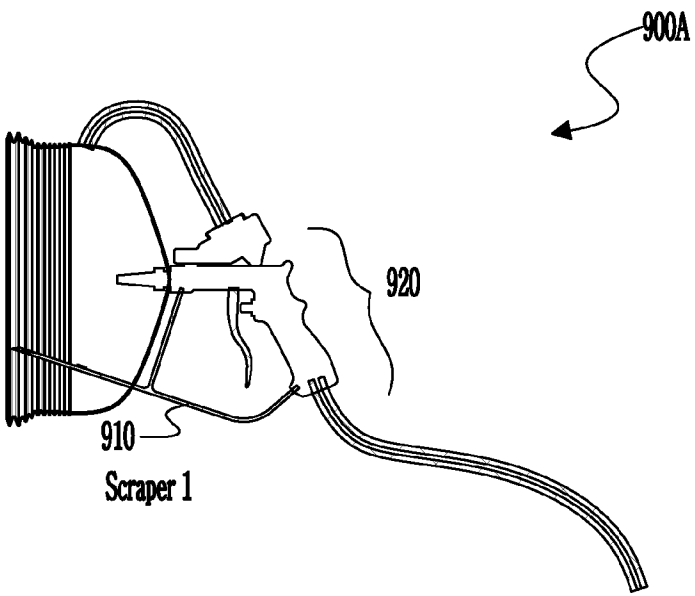

With reference to FIGS. 9A-9B, there is presented perspective views of a scraper and sandblaster assembly where the scraper is releasably detachable from the sandblaster portion of the assembly, in accordance with the present disclosure.

In FIG. 9A, in a first scraper configuration 900A, the first scraper 910 is releasably detachable to the sandblaster 920 in the scraper and sandblaster assembly. In this exemplary embodiment, the user is permitted to release and insert any type of scraper desirable. For example, in FIG. 9B, in a second scraper configuration 900B, a second scraper 910' is attached to the sandblaster 920. The second scraper 910' includes, for example, a bent or curved portion 912. Thus, the user may utilize a single blade scraper or a dual blade scraper or a curved configuration or a bent configuration or any other type of scraper contemplated by one skilled in the art. One skilled in the art may contemplate a plurality of different attachment/detachment mechanisms (e.g., snapping mechanism, interlocking mechanism, screw mechanism, twisting mechanism, etc.).

Figure 10:
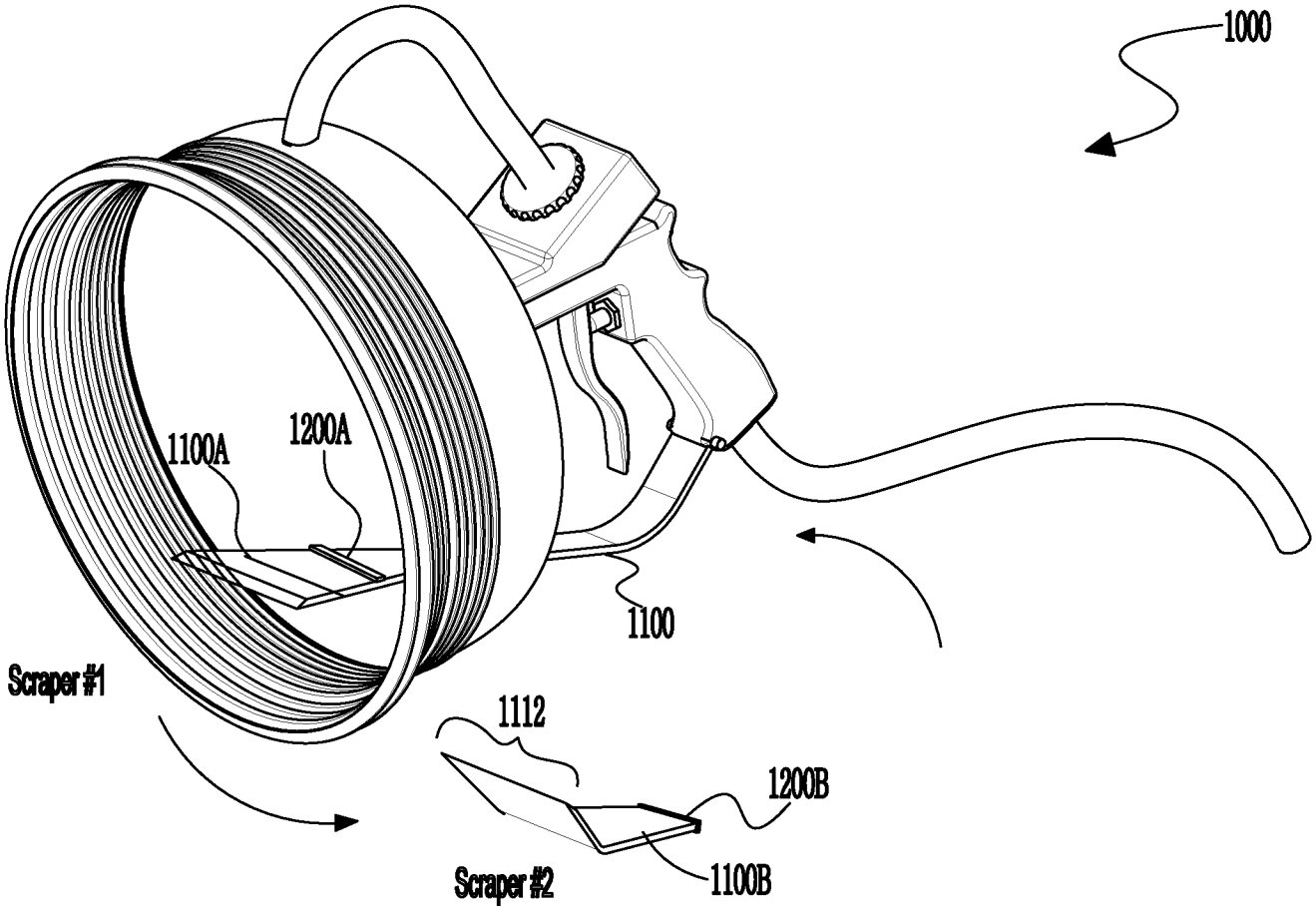
FIG. 10 is a perspective view of a scraper and sandblaster assembly where the scraper head is releasably detachable from the scraper of the assembly, in accordance with the present disclosure.

With reference to FIG. 10, there is presented a perspective view of a scraper and sandblaster assembly where the scraper head is releasably detachable from the scraper of the assembly, in accordance with the present disclosure.

In this exemplary embodiment, the user is permitted to release and insert any type of scraper head desirable to the scraper. As such, in contrast to FIGS. 9A-9B, the user need only replace the head of the scraper from a single blade to a dual blade to any other type of scraper head desirable.

In FIG. 10, the first scraper head 1100A is releasably detachable to the scraper 1100 in the scraper and sandblaster assembly 1000. A user may instead want to utilize a second scraper head 1100B having a curved or bent configuration 1112. The first scraper head 1100A may be releasably attachable to the scraper 1100 via connection mechanism 1200A. A user may snap off the first scraper head 1100A and insert second scraper head 1100B. Second scraper head 1100B may include a connection mechanism 1200B for connecting to the scraper 1100. One skilled in the art may contemplate a plurality of different attachment/detachment mechanisms (e.g., snapping mechanism, interlocking mechanism, screw mechanism, twisting mechanism, etc.). One skilled in the art may contemplate connecting the scraper(s) or scraper head(s) on any portion or portions of the scraper and sandblaster mechanisms described herein. It is contemplated that a plurality of scrapers may be used on any of the scraper and sandblasting mechanisms described herein. The plurality of scrapers may be positioned or extend through the lower or upper portions of the debris collection cover.

With reference to FIGS. 11A-11I, there is presented a plurality of front views of different nozzle configurations, in accordance with the present disclosure.

Figures 11A, 11B, 11C, 11D, 11E, 11F, 11G, 11H, 11I:
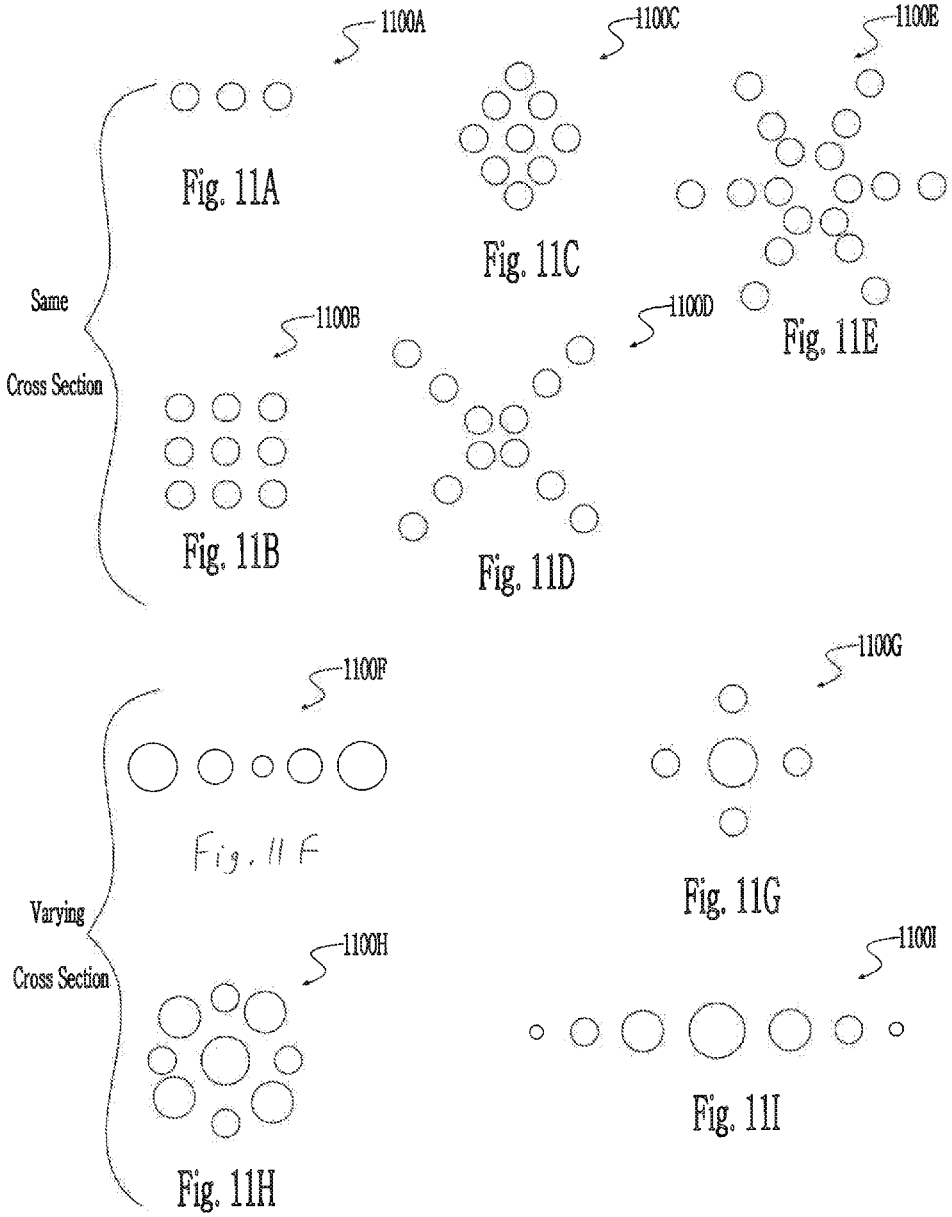
FIGS. 11A-11I are a plurality of front views of different nozzle configurations, capable of being incorporated into FIGS. 1-10, in accordance with the present disclosure.

FIG. 11A illustrates a series configuration 1100A, FIG. 11B illustrates a rectangular block configuration 1100B, FIG. 11C illustrates a diamond configuration 1100C, FIG. 11D illustrates an "X" configuration 1100D, and FIG. 11E illustrates a star configuration 1100E. Additionally, FIGS. 11A-11E illustrate nozzle configurations having substantially the same cross-section. However, the cross-sections of the nozzles may be of varying cross-sections. For example, FIG. 11F illustrates a series configuration 1100F of sequentially varying cross-sections, FIG. 11G illustrates a cross configuration 1100G, with exterior nozzles having a smaller cross-section than a middle nozzle, FIG. 11H illustrates a circular configuration 1100H with varying cross-sectional nozzles, and FIG. 11I illustrates a series configuration 1100I with a combination ascending and descending nozzle size cross-sections.

The nozzle configurations 11A-11I may have different cross-sections in order to achieve rapid dispersal of the granular particles onto a surface of an article or object with low mass air flow from the air supply source 30 (see FIG. 1). The plurality of nozzles may be configured for selective or collective activation. Additionally, each of the plurality of nozzles may be dimensioned and adapted to have different cross-sections to enable dispersal rates of the granular particles.

Therefore, in summary, it would be desirable to provide a method and apparatus that provides extended coverage greater in some instances than would otherwise be obtained by a single sandblasting gun having a single nozzle. It is also desirable to provide a method and apparatus that treats articles and/or objects relatively evenly and in a suitably uniform manner without undesirably damaging the article and/or object. It is also desirable to provide a dual functional, yet versatile tool that permits a scraper to be operable in conjunction with a sandblaster for rapid and efficient abrasion of a surface.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

It should be noted that the language used in the specification has been principally selected for readability and instructional purposes, and may not have been selected to delineate or circumscribe the inventive subject matter. Accordingly, the disclosure is intended to be illustrative, but not limiting, of the scope of the present disclosure.

Having described the present disclosure above, various modifications of the techniques, procedures, materials and equipment will be apparent to those in the art. It is intended that all such variations within the scope and spirit of the appended claims be embraced thereby.

The foregoing examples illustrate various aspects of the present disclosure and practice of the methods of the present disclosure. The examples are not intended to provide an exhaustive description of the many different embodiments of the present disclosure. Thus, although the foregoing present disclosure has been described in some detail by way of illustration and example for purposes of clarity and understanding, those of ordinary skill in the art will realize readily that many changes and modifications may be made thereto without departing form the spirit or scope of the present disclosure.

What is claimed is:

1. A scraper and sandblaster assembly, comprising:

a sandblaster including at least a debris collection cover and a granular particle container for holding granular particles; and a scraper configured to operate with the sandblaster;

wherein the granular particle container includes a plurality of separate and distinct chambers, each chamber including a different granular particle.

2. The scraper and sandblaster assembly according to claim 1, wherein the sandblaster includes at least one actuation mechanism for selectively dispensing the different granular particles.

3. The scraper and sandblaster assembly according to claim 1, wherein the sandblaster includes at least one actuation mechanism for collectively dispensing the different granular particles.

4. The scraper and sandblaster assembly according to claim 1, wherein the debris collection cover is configured to facilitate recycling of at least a portion of the granular particles dispensed from the granular particle container.

5. The scraper and sandblaster assembly according to claim 1, wherein the scraper extends at least partially within the debris collection cover of the sandblaster.

6. The scraper and sandblaster assembly according to claim 1, wherein the scraper is a flat-bladed scraper.

7. The scraper and sandblaster assembly according to claim 1, wherein the debris collection cover includes a compressible portion configured to deflect in opposed relation to a direction of expulsion of the granular particles dispensed from a nozzle portion of the sandblaster.

8. The scraper and sandblaster assembly according to claim 1, wherein the granular particles are at least one of sand, steel grit, steel shot, copper slag, coal slag, walnut shells, coconut shells, powdered quartz, emery, chilled iron globules, glass beads, corn cob, pumice, crushed glass grit, silicon-carbide grit, aluminum-oxide, staurolite minerals, powdered abrasives, and plastic abrasives or a combination thereof.

9. The scraper and sandblaster assembly according to claim 1, wherein the scraper is releasably detachable to the sandblaster.

10. The scraper and sandblaster assembly according to claim 1, wherein a head portion of the scraper is releasably detachable to the scraper.

11. A method of abrading a surface, the method comprising:

operating a sandblaster with a scraper, the sandblaster including at least a debris collection cover and a granular particle container for holding granular particles; and constructing the granular particle container with a plurality of separate and distinct chambers, each chamber including a different granular particle.

12. The method according to claim 11, further comprising incorporating at least one actuation mechanism with the sandblaster for selectively dispensing the different granular particles.

13. The method according to claim 11, further comprising incorporating at least one actuation mechanism with the sandblaster for collectively dispensing the different granular particles.

14. The method according to claim 11, further comprising facilitating recycling of at least a portion of the granular particles dispensed from the granular particle container via the debris collection cover.

15. The method according to claim 11, further comprising allowing the scraper to extend at least partially within the debris collection cover of the sandblaster.

16. The method according to claim 11, wherein the scraper is a flat-bladed scraper.

17. The method according to claim 11, further comprising providing the debris collection cover with a compressible portion for deflecting in opposed relation to a direction of expulsion of the granular particles dispensed from a nozzle portion of the sandblaster.

18. The method according to claim 11, wherein the granular particles are at least one of sand, steel grit, steel shot, copper slag, coal slag, walnut shells, coconut shells, powdered quartz, emery, chilled iron globules, glass beads, corn cob, pumice, crushed glass grit, silicon-carbide grit, aluminum-oxide, staurolite minerals, powdered abrasives, and plastic abrasives or a combination thereof.

19. The method according to claim 11, further comprising releasably detaching the scraper from the sandblaster.

20. The method according to claim 11, further comprising releasably detaching a head portion of the scraper from the scraper.

* * * * *